United States Patent [19]

Lindner et al.

[11] Patent Number: 4,824,337

[45] Date of Patent: Apr. 25, 1989

[54] VALVE ASSEMBLY FOR AN OSCILLATING PUMP

[75] Inventors: Darrell M. Lindner, Ashland; John R. Freeman, Bellville, both of Ohio

[73] Assignee: The Gorman-Rupp Company, Bellville, Ohio

[21] Appl. No.: 137,592

[22] Filed: Dec. 24, 1987

[51] Int. Cl.[4] ..... F04B 17/04; F04B 21/04

[52] U.S. Cl. ..... 417/417; 417/550; 417/566

[58] Field of Search ..... 417/417, 418, 550, 566; 137/512.15

[56] References Cited

U.S. PATENT DOCUMENTS

| | | | |
|---|---|---|---|
| 2,291,603 | 8/1942 | Barker | 137/512.15 |
| 2,872,871 | 2/1959 | Allen | 417/417 |
| 2,954,048 | 9/1960 | Rychlik | 137/512.15 |
| 3,022,796 | 2/1962 | Cummings | 137/512.15 |
| 3,250,219 | 5/1966 | McCarty et al. | 417/550 |
| 3,312,237 | 4/1967 | Mon et al. | 137/512.15 |
| 3,354,903 | 11/1967 | Caruso | 137/512.15 |
| 3,479,959 | 11/1969 | Christensen | 417/418 |
| 3,849,031 | 11/1974 | Charboneau | 417/417 |
| 4,375,941 | 3/1983 | Child | 417/418 |

FOREIGN PATENT DOCUMENTS

| | | | |
|---|---|---|---|
| 1202417 | 1/1960 | France | 137/512.15 |

OTHER PUBLICATIONS

Blueprint Copy, p. A.
Blueprint Copy, p. B.

*Primary Examiner*—William L. Freeh
*Attorney, Agent, or Firm*—Renner, Kenner, Greive, Bobak, Taylor & Weber

[57] ABSTRACT

A valve assembly (16) for an oscillating pump (10) of the type having a reciprocating armature (12) which carries an impeller (13) includes a rigid valve seat (17) carried by and movable with the impeller (13). The assembly (16) also includes an elastomeric valve (18) which is carried by the valve seat (17) within the impeller (13) and which divides the pump chamber therein into an inlet side (14) and outlet side (15). Reciprocation of the armature (12) first causes the valve (18) to engage the valve seat (17) to discharge fluid from the outlet side (15) of the pump chamber and then causes the valve (18) to disengage the valve seat (17) to permit fluid to pass from the inlet side (14) to the outlet side (15) of the pump chamber.

6 Claims, 2 Drawing Sheets

VALVE ASSEMBLY FOR AN OSCILLATING PUMP

TECHNICAL FIELD

This invention relates to a valve and valve seat assembly. More particularly, this invention relates to a valve which is particularly suitable for an oscillating pump and which operates within and is held by a valve seat to provide an efficiently operated oscillating pump.

BACKGROUND ART

Oscillating pumps utilizing leaf-type check valves to move fluids through a pumping chamber are known in the art. For example, in one type of pump, an elastomeric leaf valve was formed as part of the impeller with the leaves and stem of the valve being attached internally of the elastomeric pump impeller. Then during the manufacturing process the valve leaves were cut free of the impeller to be operable therein. However, such a system provided inconsistent and inefficient pump performance because as the pressure caused the valve leaves to deform slightly during pump operation, the leaves did not always seal properly against the irregular surface of the impeller from which they were severed.

Other efforts to provide more consistent valve performance have likewise been deficient. For example, attempts were made to mold a one-piece leaf valve with its valve stem being part of a tubular elastomeric retainer which was snapped into a recess in the pump impeller. However, the inherent flexible nature of the elastomeric retainer, being made of the same material as the leaf portion of the valve, was not strong enough to resist collapse of the impeller, caused by the high internal vacuum of the pump. Further, the retainer could thereby easily work its way out of the recess in the impeller. Finally, the seal between the valve leaves and the flexible impeller was still capable of failure and inconsistent performance.

DISCLOSURE OF THE INVENTION

It is thus a primary object of the present invention to provide a valve and separate valve seat for an oscillating pump in which the valve will continually seal with reliability against the valve seat.

It is another object of the present invention to provide a valve and separate valve seat for an oscillating pump, as above, wherein the valve seat is made of a rigid plastic material providing a smooth surface for the elastomeric valve.

It is a further object of the present invention to provide a valve and separate valve seat for an oscillating pump, as above, wherein the valve seat includes means to retain the valve in place.

It is yet another object of the present invention to provide a valve and separate valve seat for an oscillating pump wherein the valve seat will reliably be maintained longitudinally positioned within the impeller of the pump.

These and other objects of the present invention, which will become apparent from the description to follow, are accomplished by the improvements hereinafter described and claimed.

In general, an oscillating pump, of the type having an armature activated to reciprocate an impeller which defines a pump chamber, is provided with a valve assembly which includes a rigid valve seat carried by and movable with the impeller and an elastomeric valve carried by and engageable with the valve seat. Upon reciprocation of the impeller, fluid is alternatingly drawn into and discharged from the pump chamber.

PREFERRED EMBODIMENT FOR CARRYING OUT THE INVENTION

Figure 1:
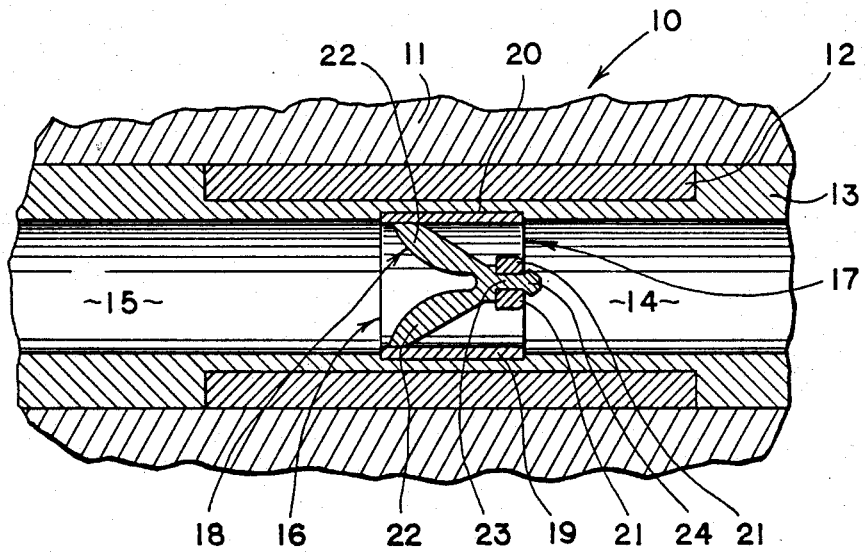
FIG. 1 is a longitudinal sectional view of a portion of an oscillating pump, somewhat schematically shown, and depicting the valve and valve seat according to the concept of the present invention.

A portion of an oscillating pump having a valve and valve seat assembly according to the concept of the present invention is indicated generally by the numeral 10 in the drawings and is shown as including a pump housing 11, a metallic armature 12, and a generally cylindrical elastomeric impeller 13—all schematically shown and all conventional parts of a typical electrically operated oscillating pump. The internal surface of impeller 13 generally defines a longitudinally extending pump chamber having an inlet side 14 and an outlet side 15.

The valve and valve seat assembly according to the present invention is indicated generally by the numeral 16 and is located in the pump chamber between inlet side 14 and outlet side 15. Assembly 16 includes a valve seat indicated generally by the numeral 17 and a check valve indicated generally by the numeral 18.

Figure 4:
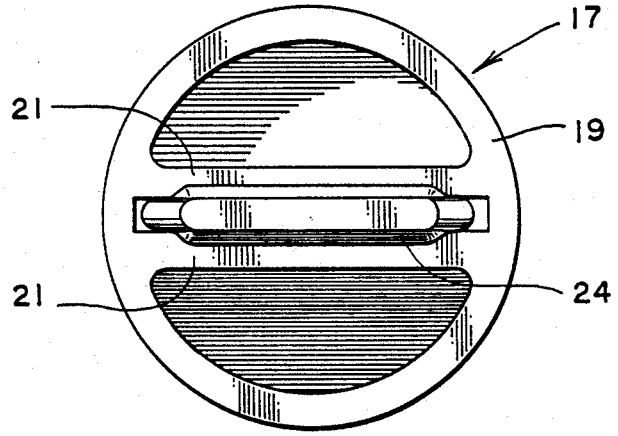
FIG. 4 is an end view of the valve and valve seat assembly taken from the inlet side of the pump chamber.

Valve seat 17 is constructed of a rigid plastic material, such as glass reinforced polypropylene, and includes a cylindrical portion 19 which fits into a cylindrical recess 20 molded into the inner wall of impeller 13. As best shown in FIG. 4, valve seat 17 is also provided with two cross bars 21 spanning the inside of cylindrical portion 19 on the inlet side 14 of the pump chamber which, as will be hereinafter described, holes valve 18 in place.

Check valve 18 is constructed of an elastomeric material and is shown to be of the type commonly known as a leaf valve having two flexible leaves 22 which in their normal position engage the inner side of valve seat portion 19 thereby closing the inlet side 14 of the pump chamber from the outlet side 15. Leaves 22 are connected at their bases to a valve stem 23 which has a lock barb 24 on the end thereof.

Valve 18 and valve seat 17 are assembled by sliding valve 18 into the cylindrical portion 19 of seat 17 and snapping barb 24 through the opening between cross bars 21 of valve seat 17 whereby the cross bars engage valve stem 23 thereby holding valve 18 in place with leaves 22 engaging the inner side of cylindrical portion 19 of valve seat 17. The valve and valve seat assembly 16, which is of a slightly larger outer diameter than the inner diameter of impeller 13, is then slid into the flexible impeller 13 until recess 20 is reached at which point impeller 13 engages and holds assembly 16 longitudinally in place.

Figure 2:
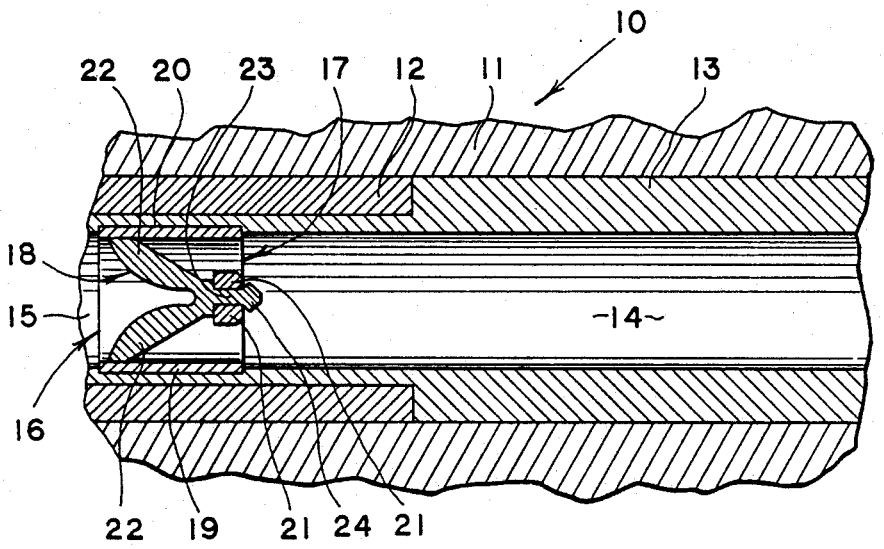
FIG. 2 is a view similar to FIG. 1 and sequentially following FIG. 1 during the operation of the pump showing the valve and valve seat displaced during movement of the impeller to discharge fluid from the pump chamber.
Figure 3:
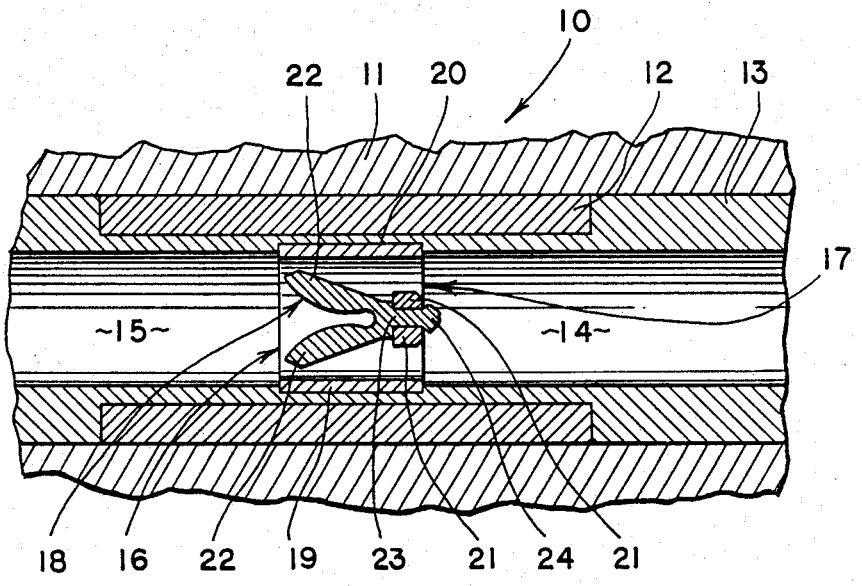
FIG. 3 is a view similar to FIGS. 1 and 2 and sequentially following FIG. 2 showing the valve and valve seat during the return movement of the impeller from the position of FIG. 2 to the position of FIG. 1 to position another charge of fluid on the outlet side of the valve in the pump chamber.

In operation, magnetic impulses generated by an electrical coil (not shown) in pump 10 causes the metallic armature 12 to longitudinally reciprocate within housing 11 at a rate dependent on the electrical frequency, typically 60 Hz. Thus, on the forward or discharge stroke of armature 12, it moves from the FIG. 1 to the FIG. 2 position carrying with it impeller 13 and valve end valve seat assembly 16. The dynamic forces involved keep valve 18 closed, that is, leaves 22 are pressed tightly against the inside of valve seat portion 19 thereby causing the fluid in the outlet side 15 of the pump chamber to be expelled from pump 10. In the absence of a magnetic impulse, armature 12 moves back from the FIG. 2 position to the FIG. 1 position under the influence of a spring (not shown), such movement being depicted in FIG. 3. As leaves 22 of valve 18 encounter the pressure of the fluid in the inlet side 14 of the pump chamber, they flex axially inwardly, as shown in FIG. 3, thereby permitting fluid in the inlet side 14 of the pump chamber to be transferred to the outlet side 15 for discharge on the next discharge stroke of armature 12. The reciprocation of armature 12 at the 60 Hz rate permits an efficient and continuous pumping of fluid without adverse effect on the valve leaves 22 inasmuch as they move into and out of engagement with the smooth rigid valve seat portion 19 as opposed to the somewhat irregular and flexing surface of impeller 13.

It should be appreciated that the valve and valve seat assembly described herein could be utilized in environments other than that described. Thus, the assembly could be advantageously provided in many fluid handling situations where single direction flow is desired. Even multiple assemblies could be provided in an oscillating pump such as pump 10 shown herein. For example, a stationary valve seat 17 and valve 18 combination could be positioned, as described, either on the inlet side, the outlet side, or both sides, of pump 10, if desired.

From the foregoing it should be evident that a valve and valve seat assembly constructed as described herein accomplishes the objects of the present invention and otherwise improves the fluid handling art.

We claim:

1. A valve assembly for an oscillating pump of the type having a reciprocating armature carrying an impeller which defines a pump chamber for the passage of fluid, the assembly comprising a valve seat made of a rigid material and carried by the impeller for reciprocating therewith, and an elastomeric valve carried by said valve seat, said valve including a valve stem and a retaining barb at the end of said valve stem, said valve seat including a cylindrical portion engageable by said valve, and means extending across said cylindrical portion within the pump chamber to engage said valve stem, said retaining barb maintaining said means engaged with said valve stem, said valve being in the pump chamber and dividing the same into a pump inlet side and pump outlet side such that during reciprocation of the impeller said valve alternatingly discharges fluid from said pump outlet side by engagement with said valve seat and permits the passage of fluid from said pump inlet side to said pump outlet side by disengagement from said valve seat.

2. A valve assembly according to claim 1 wherein the impeller is provided with an internal cylindrical recess to receive and engage said cylindrical portion of said valve seat.

3. A valve assembly according to claim 1 wherein said valve includes leaves engageable with said valve seat.

4. An oscillating pump comprising a housing, a metallic armature reciprocatable with respect to said housing, an impeller carried by said armature and defining a pump chamber for the passage of fluid, a rigid plastic valve seat carried by said impeller, and an elastomeric valve carried by said valve seat in said pump chamber and dividing said pump chamber into an inlet side and an outlet side, said valve including a valve stem and means to alternatingly engage and disengage said valve seat during reciprocation of said armature to respectively alternatingly discharge fluid from said outlet side of said pump chamber and permit the passage of fluid from said inlet side of said pump chamber to said outlet side of said pump chamber, said valve seat including a cylindrical portion carried by said impeller, said cylindrical portion being engaged by said means to alternatingly engage and disengage said valve seat, means extending across said cylindrical portion within said pump chamber to engage said valve stem, and means at the end of said valve stem to assure engagement of said means extending across said cylindrical portion with said valve stem.

5. An oscillating pump according to claim 4 wherein said means to alternatingly engage and disengage said valve seat includes flexible valve leaves.

6. An oscillating pump according to claim 4 further comprising a recess in said impeller, said recess receiving said cylindrical portion of said valve seat.

* * * * *